US010413921B1

(12) United States Patent
van der Steur et al.

(10) Patent No.: US 10,413,921 B1
(45) Date of Patent: Sep. 17, 2019

(54) ROTARY BELL CUP ATOMIZER WITH AUXILIARY TURBINE AND VORTEX SHAPING AIR GENERATOR

(71) Applicants: Gunnar van der Steur, Chesapeake City, MD (US); Joseph Cichocki, Newark, DE (US)

(72) Inventors: Gunnar van der Steur, Chesapeake City, MD (US); Joseph Cichocki, Newark, DE (US)

(73) Assignee: EFC Systems, Inc., Havre de Grace, MD (US)

( * ) Notice: Subject to any disclaimer, the term of this patent is extended or adjusted under 35 U.S.C. 154(b) by 0 days.

(21) Appl. No.: 16/353,075

(22) Filed: Mar. 14, 2019

(51) Int. Cl.

| | |
|---|---|
| ***B05B 7/10*** | (2006.01) |
| ***B05B 1/02*** | (2006.01) |
| ***B05B 3/10*** | (2006.01) |
| ***B05B 1/34*** | (2006.01) |

(52) U.S. Cl.
CPC ..... *B05B 7/10* (2013.01); *B05B 1/02* (2013.01); *B05B 1/3405* (2013.01); *B05B 3/1014* (2013.01)

(58) Field of Classification Search
CPC ..... B05B 7/10; B05B 1/3405; B05B 1/02; B05B 3/1014; B05B 3/1035; B05B 3/0418; B05B 1/28; B05B 3/1092; B05B 5/0403; B05B 7/0815; B05B 15/001; B05B 5/0407; B05B 5/0426; B05B 7/08; B05B 7/1486; F16C 32/0677; F16C 43/02; F16C 27/02; F16C 32/0618; F16C 32/0696; F16C 33/1005; F16C 32/0614; F16C 33/043; F16C 2320/42; F16C 2206/02; F16C 2208/10
See application file for complete search history.

(56) References Cited

U.S. PATENT DOCUMENTS

| | | | | |
|---|---|---|---|---|
| 4,601,921 | A | 7/1986 | Lee | |
| 6,053,428 | A | 4/2000 | Van der Steur | |
| 7,611,069 | B2 | 3/2009 | Clifford et al. | |
| 9,375,734 | B1 * | 6/2016 | van der Steur | B05B 3/1092 |
| 9,604,233 | B2 * | 3/2017 | Yamauchi | B05B 3/1035 |
| 9,833,797 | B2 | 5/2017 | Yamada et al. | |

* cited by examiner

*Primary Examiner* — Arthur O. Hall
*Assistant Examiner* — Steven M Cernoch
(74) *Attorney, Agent, or Firm* — E. Alan Uebler, P.A.

(57) ABSTRACT

The invention provides apparatus for spray coating of substrates using a rotary bell cup atomizer equipped with an air-driven main turbine and a supply of pressurized primary shaping air conveyed through primary shaping air channels and nozzles for controlling the shape of the atomized spray pattern exiting the bell cup edge, the apparatus further including an auxiliary, independently air-driven turbine equipped with a rotatable vortex generator, and including a separate air supply of secondary shaping air for supplying secondary shaping air through secondary air channels and nozzles to further control the shape of the atomized spray pattern exiting the bell cup, which secondary shaping air, on passing through the vortex generator, produces a curtain of shaping air in a vortex-like pattern, which, in conjunction with and mixing with the primary shaping air from the primary air nozzles, produces improved pattern control, transfer efficiency and quality of coating on the substrate.

15 Claims, 8 Drawing Sheets

ROTARY BELL CUP ATOMIZER WITH AUXILIARY TURBINE AND VORTEX SHAPING AIR GENERATOR

FIELD OF THE INVENTION

The invention relates to rotary bell cup atomizers and is especially useful in the automotive industry in robotic painting of vehicle body parts.

BACKGROUND OF THE INVENTION

The invention provides rotary bell cup atomizers generally useful in the coating of substrates. Rotary bell cup atomizers are commonly used in coating operations such as, for example, the painting of vehicle body parts. These coating operations are carried out, in the main, by either robotically mounted and controlled atomizers or by hand-held spray gun atomizers. Both coat various work-pieces by operation of bell cup rotating atomizers affixed thereto.

Rotary atomizers are used in liquid based paint coating operations and bell cup rotary devices are also used in powder coating operations. The invention herein described and claimed can be useful in both types, either robotically or machine mounted, or applied via hand-held spray gun.

Rotary atomizers which are used in coating various substrates employ centrifugal forces generated by a rotating bell cup to atomize paint supplied thereto. In a conventional process, pressurized air is directed as an axially-extending shroud around the periphery of the atomized paint and this shroud controls the disposition pattern of paint particles deposited on the work-piece. Electrostatic charging may be used to assist in attracting the atomized particles to the substrate, all of which is known.

Examples of state-of-the-art rotary bell cup atomizers are found in prior patents of one or both of the named inventors herein, specifically in U.S. Pat. Nos. 7,056,397, 6,676,049, 6,341,734, 6,053,428 and 5,862,988.

In the spray painting of vehicle bodies, for example, improvements in application methods continue, specifically in enhancements to the spray pattern geometry produced on the substrate, a result of which is controlled by the velocity and direction of the shaping air flowing axially and peripherally about the outside edge of the bell cup and enveloping the sprayed coating exiting the cup.

The quality of the final coating is dependent upon many variables in addition to the velocity and direction of the atomized paint particles, among them being the electrostatic effect in carrying the atomized charged particles to the grounded substrate. In addition, the deposited film quality and aesthetics of the applied coating are dependent upon surface irregularities, protrusions, and edges in and on the surface to be coated. Controlled shaping air cited above plays an important role in producing an acceptable, and optimal, coated final product.

An example of a method for controlling the spray pattern applied by a rotary atomizer is found in U.S. Pat. No. 7,611,069 B2 (2009). That reference is directed to an atomizer having a spray head which includes an annular shaping air ring having a plurality of nozzles for controlling the spray pattern, wherein each nozzle has a right-handed triad orientation having a base coordinate system that is placed on the longitudinal axis of the nozzle in a specified orientation. The reference is said to optimize the control of shaping air to create a stable, focused pattern that minimizes robot speed while maintaining high transfer efficiency.

U.S. Pat. No. 4,601,921 (1986) discloses a method carried out by centrifugally dispersing coating material in an annular pattern about an axis and directing a conical sheath of air forwardly through the pattern and toward a confluence on the axis with sufficient velocity to effect turbulent mixing of particles of the coating material, so that the coating material is atomized and deposited on the workpiece in a film of substantially uniform thickness. The method is said to impart a swirl component to the sheath of air to cause enlargement of the spray pattern which emerges from the confluence. The method is carried out by a rotary spray head having a forward rim for centrifugal dispersion of coating material and a vortex plenum surrounding the head provided with an annular discharge slit for projecting a conical sheath of air around the rim to direct the coating material forwardly and inwardly, and controls for the plenum airflow include an air input for air moving in a forward flow direction and another air input for tangential airflow to impart a swirl moment to the sheath of air.

A more recent patent, U.S. Pat. No. 9,833,797B2 (2007), discloses electrostatic coating apparatus which includes an air motor, a rotary atomizing head provided on a front side of the air motor to be rotatable by the air motor, external electrode units provided in a periphery of the rotary atomizing head, and a high-voltage applying unit that applies a high voltage to the external electrode units to indirectly charge paint particles atomized from the rotary atomizing head with the high voltage. In one embodiment of the disclosed apparatus, a shaping air ring is provided with first and second air spout holes wherein the shaping air ring forms part of a ground. The shaping air ring is formed in a cylindrical shape using, for example, a conductive metallic material, and is connected to ground through an air motor. The shaping air ring has an outer peripheral surface and a stepped part formed on a front end part of the shaping air ring by a protruding radial inside part of the shaping air ring.

In this embodiment, a plurality of groove parts are formed on the outer peripheral surface of the shaping air ring to mount an adaptor thereto. The plurality of groove parts are arranged to be spaced by equal intervals in the circumferential direction, whereby the stepped part is formed on the front end part of the shaping air ring by the protruding radial inside part thereof to the forward side.

The cited shaping air ring is provided with first air spout holes and second air spout holes formed therein. The first air spout holes are arranged closer to a radial inside projecting part than the stepped part of the shaping air ring and are provided along a paint releasing edge of the rotary atomizing head. These first air spout holes are arranged to line up annularly. Each of the first air spout holes is communicated with a first air passage and first shaping air is supplied to each of the first air spout holes and the air spout holes spout the first shaping air to the vicinity of the paint releasing edge of the rotary atomizing head. ('797 patent, col. 6, 1. 17, et seq.)

Second air spout holes are formed in the shaping air ring together with the first air spout holes. The second air spout holes are respectively arranged closer to a radial inside than the first air spouts holes and are arranged to line up annularly. Each of the second air spout holes is communicated with a second air passage provided in a housing member. The second shaping air having the same pressure as, or a pressure different from the shaping air, is supplied to the second air spout holes and the second air spout holes spout the second shaping air to the back surface of the rotary atomizing head. The first and second shaping air shears liquid paint released from the rotary atomizing head to accelerate formation of paint particles, and shapes an atomizing pattern of paint particles atomized from the rotary atomizing head. The pressure of the first shaping air and the pressure of the second shaping air are adjusted as needed, said to make it possible to change the atomizing pattern to a desired size or shape. ('797 patent, col. 6, 11. 50-57)

In contrast with known prior art methods for controlling the spray pattern produced by rotary atomizers, the invention provided herein controls the applied pattern using primary shaping air directed through primary shaping air nozzles located peripherally adjacent and around the bell cup outer edge and, in addition, providing secondary shaping air directed obliquely of the primary shaping air using secondary shaping air supplied through secondary shaping air nozzles also located peripherally about the outer edge of the bell cup. The secondary air is supplied to the secondary air nozzles by an auxiliary air-driven turbine which, in operation, combines the secondary shaping air and the primary shaping air to provide separate, controllable and adjustable shaping of atomization patterns over wide ranges, thereby producing unique, heretofore unachievable final coatings.

SUMMARY OF THE INVENTION

Apparatus for coating a substrate is provided, including a rotatable bell cup coating applicator affixed to the distal end of a rotatable main drive shaft driven by a main turbine, a source of supply of coating material, and wherein the main drive shaft has an axial conduit therethrough for supplying coating material from the source to and through the main drive shaft and into the bell cup for spraying the coating material onto the substrate upon actuation of rotation of the main drive shaft. The apparatus is further characterized as having multiple pressurized air sources and air passageways formed within and through the apparatus to convey air to and through the apparatus, including a first source of pressurized air for driving the main turbine, a second source of pressurized air for creating and directing a first curtain of shaping air circumferentially, axially and externally about the bell cup to envelop, control and shape the diameter and pattern of the coating material sprayed from the bell cup, this first curtain of shaping air being formed by air conveyed from the second source of pressurized air and channeled through passageways in the apparatus to and through a first plurality of axially oriented nozzles positioned circumferentially adjacent to and around the outer edge of the bell cup, to form the first curtain of shaping air. Also included is a second, hollow, independently rotatable drive shaft mounted upon, radially and externally of, and being concentric with, the main drive shaft, this second drive shaft being driven by a second, auxiliary turbine. Further included is a third source of pressurized air for driving and controlling the auxiliary turbine independently and separately from the main turbine. The apparatus further includes a fourth source of air for creating a second curtain of shaping air circumferentially, axially and externally about the bell cup to further control and shape the diameter and pattern of the coating material being sprayed from the bell cup, this second curtain of shaping air being formed by the air conveyed from the fourth source of pressurized air and channeled through passageways in the apparatus to and through a second plurality of axially oriented nozzles positioned circumferentially adjacent to and around the outer edge of the bell cup and in immediate proximity to the first plurality of nozzles, such that, in operation on actuation of the turbines, thereby forming the second curtain of shaping air. The apparatus also includes a vortex generator mounted on the second drive shaft proximate the distal end of the second drive shaft adjacent the outer surface of the bell cup, the vortex generator having a truncated annular shape with an inner surface extending along and generally mirroring the outer surface of the adjacent bell cup, the vortex generator being rotatable within a gap provided between the bell cup and the vortex generator, the vortex generator having a distal edge extending to near proximity with the spray edge of the adjacent bell cup and having a plurality of shaped vanes affixed thereto and therearound proximate the distal edge of the vortex generator and extending perpendicularly and outwardly therefrom. These vanes are configured with respect to the second plurality of nozzles such that, in operation, the second curtain of shaping air exiting from the second plurality of nozzles is directed to, impacts and passes between these rotating vanes, is deflected by the vanes, and is mixed with the first curtain of shaping air emerging from the adjacent first plurality of nozzles, the mixed first and second curtains of shaping air thereby producing a final, mixed, applied curtain of shaping air for ultimately controlling the pattern of the coating sprayed onto the substrate. The shaping air exiting from the second plurality of nozzles is intended to be deflected by the vanes in a swirl pattern.

The rotatable bell cup coating applicator and the rotatable vortex generator can be rotatable in opposite directions or, alternatively, in the same direction. All nozzles within the first plurality of nozzles can be directed in parallel with the axis of rotation of the rotatable bell cup or they can be directed angularly with respect to the axis of rotation of the rotatable bell cup. All nozzles within the second plurality of nozzles can be directed in parallel to the axis of rotation of the rotatable bell cup, or they can be directed angularly with respect to the axis of rotation of the rotatable bell cup.

The plurality of shaped vanes can extend linearly and proximally inwardly from the distal edge of the vortex generator or they can extend in a curvilinear fashion inwardly and proximally from the distal edge of the vortex generator.

Preferably, the first plurality of axially oriented nozzles includes 10 to 120 nozzles and the second plurality of axially oriented nozzles includes 10 to 120 nozzles.

The apparatus can be useful in paint or powder coating processes.

DETAILED DESCRIPTION OF THE INVENTION AND PREFERRED EMBODIMENTS WITH REFERENCE TO THE DRAWINGS

The invention provides apparatus for spray coating of substrates using a rotary bell cup atomizer equipped with an air-driven main turbine and a supply of pressurized primary shaping air conveyed through primary shaping air channels and nozzles for controlling the shape of the atomized spray pattern exiting the bell cup edge, the apparatus further including a second auxiliary drive shaft driven by an auxiliary turbine equipped with a rotatable vortex generator mounted on the auxiliary drive shaft. Also included is a separate air supply of secondary shaping air for supplying secondary shaping air through secondary air channels and nozzles to further control the shape of the atomized spray pattern exiting the bell cup, which secondary shaping air, on passing through the vortex generator, produces a secondary curtain of shaping air in a vortex-like pattern, which, in conjunction with and mixing with the primary shaping air from the primary air nozzles, together produce improved pattern control, transfer efficiency and quality of coating on the substrate.

Figure 1:
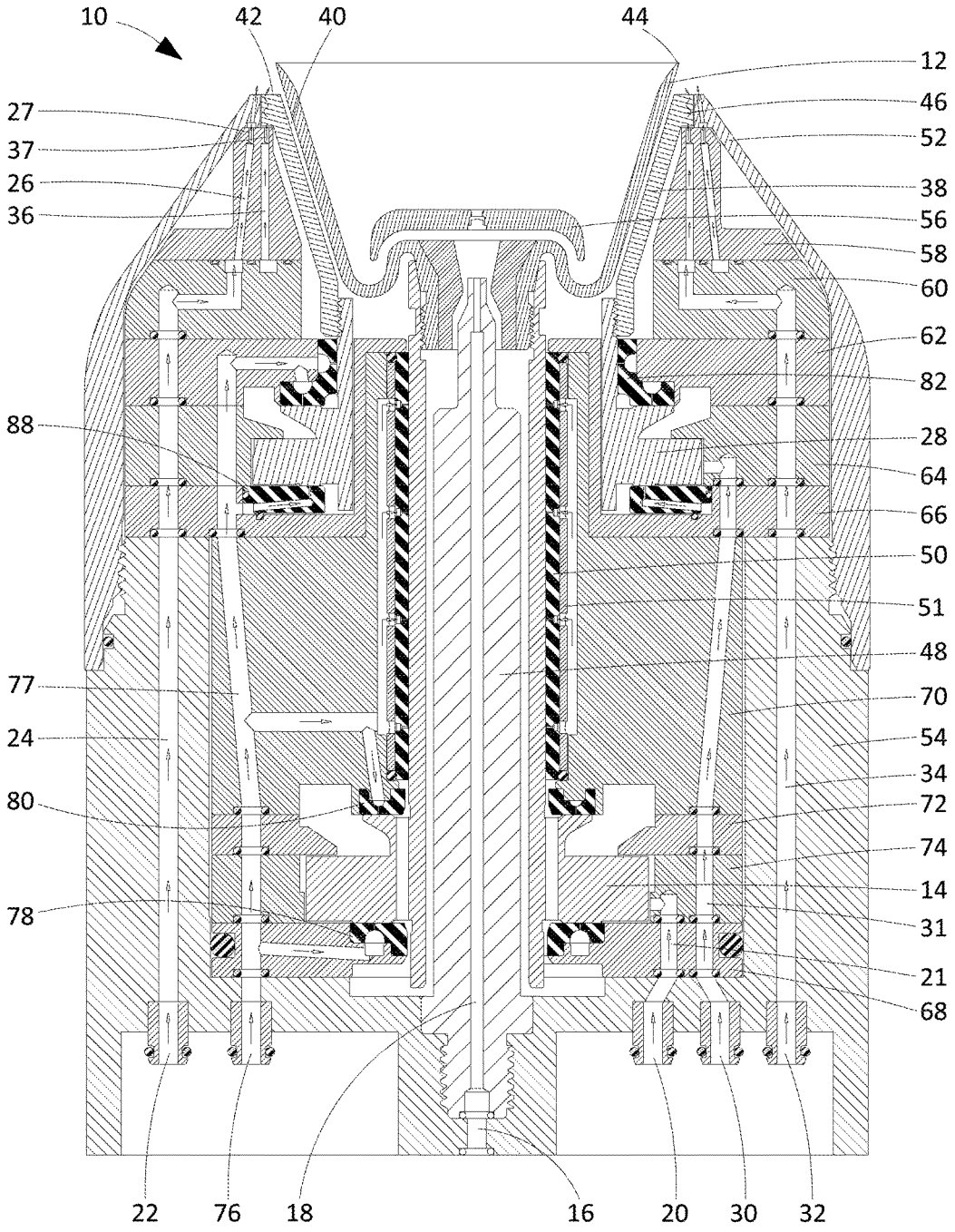
FIG. 1 is a cross-sectional view of one embodiment of the invention.

Referring to FIG. 1, the rotary bell cup atomizer 10 of the invention is shown to include bell cup 12 mounted at the distal end of main drive shaft/fly wheel 14, the main drive shaft 14 rotatably driven by drive air entering inlet 20. The drive air throughput is depicted by small arrows within the channel 21 downstream from the air supply inlet 20 and directed, as shown, schematically, to the turbine/flywheel to power the rotating drive shaft 14. Coating material, e.g. paint, is fed to paint injector 48 housed in main drive shaft 14 through supply inlet 16 and thence into the conduit 18 and flows therethrough to and into the bell cup 12, impinging onto the deflector 56, from which the coating material is deflected radially outwardly to and over the inside surface of the rotating bell cup 12, flowing thereover to the distal edge 44 of the cup 12 where it is atomized, all of which is known in the art.

The rotating main drive shaft 14 rides within main drive shaft bearing 50, having bearing sleeve 51, and proximal main thrust bearing 78 and distal main thrust bearing 80, enabling the main drive shaft 14 to rotate completely within a surrounding envelope of air. That air is supported through main bearing air supply 76 and passes into and through channels 77, as depicted by the small arrows in FIG. 1, and passes through openings in main bearing sleeve 51 and ultimately through openings in each of the main bearings 50, 78 and 80 as shown, to provide air cushioning surrounding the main drive shaft 14. Owing to restraints on scale of the drawings, the very narrow air gaps between these bearings and all rotating surfaces is not expressly depicted, but such construction is known; see e.g., issued U.S. Pat. No. 9,970,481 B1.

Materials of construction of the components of such atomizing device are known, as described in the '481 patent. Preferred bearing material here is carbon, both solid and porous, for all main bearings.

Shaping air for shaping of the pattern of atomized coating material sprayed from the edge 44 of the bell cup 12 is supplied from a first source of shaping air 22 and channeled into and through channels 24 and into and through exit air conduits 26, and into and through a first plurality of shaping air nozzles 27, from which nozzles the air escapes and circumferentially surrounds the coating spray, thereby forming a first curtain of air around and shaping the pattern of the applied coating, all controlled by adjusting the volume of the shaping air supplied to the system from the first source of shaping air 22 to be described in more detail below.

With further reference to FIG. 1, and according to the invention, a second, hollow, independently rotatable auxiliary drive shaft 28 is mounted upon, radially and externally of, and concentric with, the main drive shaft 14, this auxiliary drive shaft 28 being driven by third source of pressurized air 30, controlled independently and separately from the main drive shaft 14.

Drive air for driving the auxiliary drive shaft 28 enters inlet 30 and passes into and through channels 31, as indicated by the small arrows shown, impinging upon the turbine blades (not shown, but see FIG. 7), to controllably and independently drive the shaft 28 separately from main drive shaft 14.

The auxiliary hollow rotational shaft 28 is also air cushioned in operation by distal auxiliary shaft bearing 82 and proximal auxiliary shaft bearing 88, which, like the main bearings 50, 78 and 80, are preferably also of carbon, either porous or solid.

As depicted in FIG. 1, a source of air for creating a second curtain of shaping air circumferentially around and shaping the sprayed coating exiting the edge 44 of cup 12 is provided by pressurized air fed through inlet 32 and channeled to and through conduits 34 and into and through exit air conduits 36 and thence into and through a second plurality of shaping air nozzles 37, from which nozzles the air escapes and circumferentially surrounds the coating spray exiting the cup edge 44, thereby forming a second curtain of air extending around and shaping the pattern of the applied coating, all controlled as with the first curtain of shaping air by adjusting, independently, the volume of air supplied to the system through the inlet 32 from the second source of shaping air, which is the fourth source of air to the system overall, including the two turbine drive air sources 30 and 76, the source of air 22 for the first curtain of shaping air described above, and this second source of shaping air entering inlet 32.

The apparatus according to the invention, as further depicted in FIG. 1, also includes a vortex generator 38 which is mounted as shown on the second, auxiliary hollow drive shaft 28, being concentric with drive shaft 28, and being affixed to and positioned proximate the distal end of shaft 28 adjacent the outer surface of the bell cup 12 as shown. The vortex generator 38 has an annular, generally truncated conical shape as shown, wherein its inner surface extends along and generally mirroring the outer surface of the adjacent bell cup 12 as indicated. The vortex generator 38 is rotatable within the gap 40 between the bell cup 12 and the vortex generator 38, as depicted in FIG. 1. The vortex generator 38 has a distal edge 42 extending to near proximity with the spray edge 44 of the bell cup 12, and has a plurality of shaped vanes 46, to be described in more detail below, which extend rearwardly from the edge 42 of the vortex generator 38 around the periphery of the vortex generator 38 and are all positioned proximate the distal edge 42 of the generator, extending perpendicularly and outwardly from the generator 38. The vanes 46 are configured with respect to the second plurality of shaping air nozzles 37 such that, in operation, the above-described second curtain of shaping air exiting from this second plurality of nozzles is directed toward, impacts, and passes between these vanes 46. On passing between the vanes 46 on the rotating vortex generator, the shaping air exiting from the second plurality of nozzles 37 is thus mixed with the air in the first curtain of shaping air emerging from the first plurality of nozzles 27, with the mixed first and second curtains of shaping air producing a final, mixed applied curtain of shaping air for controlling the pattern of coating being sprayed onto a workpiece.

Completing the assembly of components of the coating apparatus depicted in FIG. 1 are shaping air ring 58, shaping air divider plate 60, upper spacer plate 62, upper drive plate 64, upper base plate 66, lower base plate 68, top plate 70, lower spacer plate 72, lower drive plate 74, upper shroud 52 and manifold housing 54, these further components being generally known.

Figure 1A:
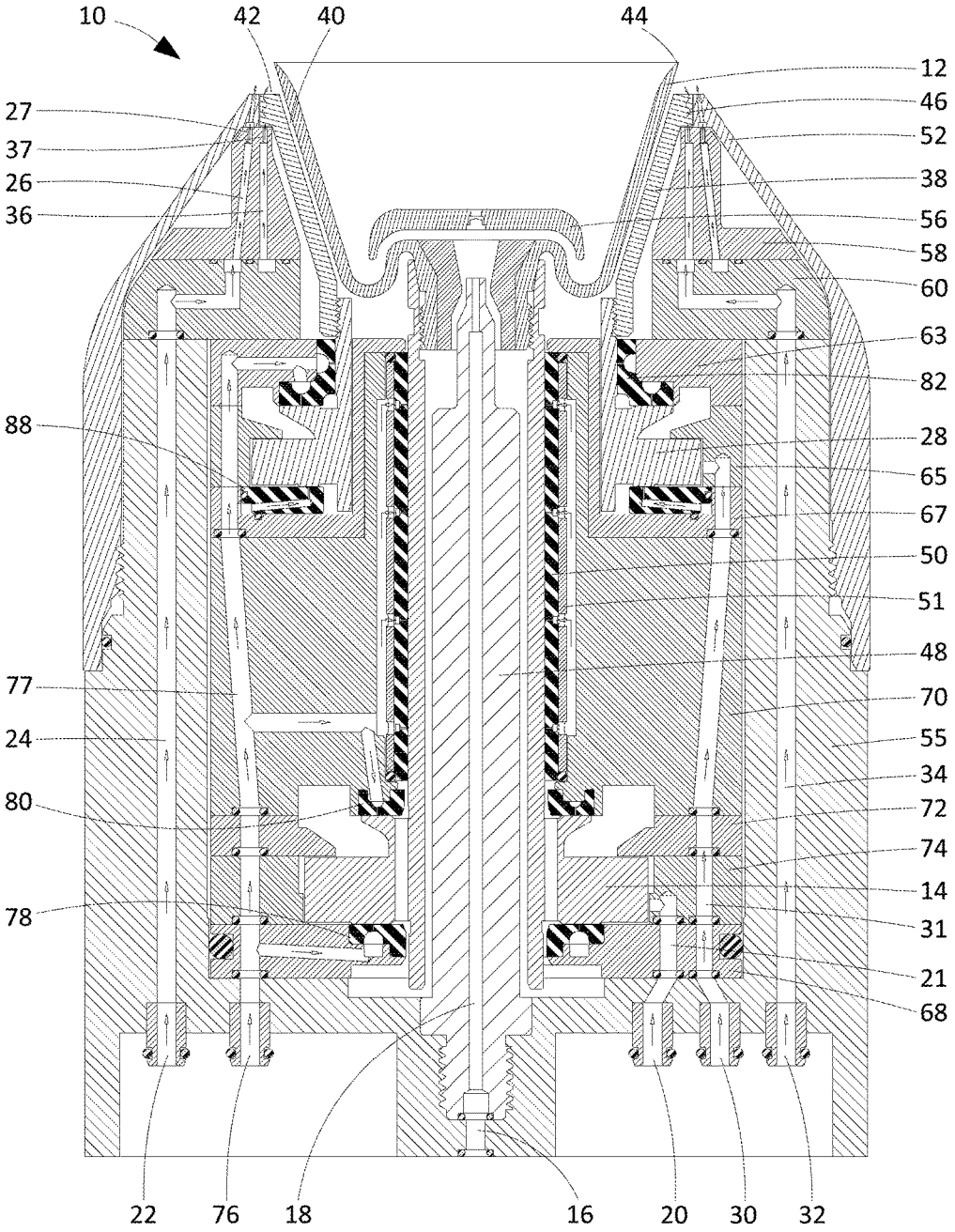
FIG. 1*a* is a cross-sectional view of an alternate embodiment of the invention.

For descriptive purposes herein and simplicity, the term "turbine" as used in connection with FIG. 1 includes components 58, 60, 62, 64, 66, 68, 70 and 74 as shown. An alternate embodiment of the invention within the appended claims is depicted in FIG. 1*a*. Common-numbered components are identical in both figures. The embodiment shown in FIG. 1 depicts an assembly of components in which all shaping air is channeled externally of the "turbine" as defined above.

In FIG. 1*a*, the alternate embodiment shown depicts an assembly in which all shaping air is channeled externally of the "turbine", wherein this alternate turbine is defined to include the following alternate components, all as depicted in the figure: upper spacer plate 63, upper drive plate 65, upper base plate 67, and manifold housing 55, all other components being commonly shown in both FIGS. 1 and 1*a*. Routing the shaping air through the turbine assembly is an embodiment disclosed in more detail in prior U.S. Pat. No. 9,375,734 B1.

Figure 2:
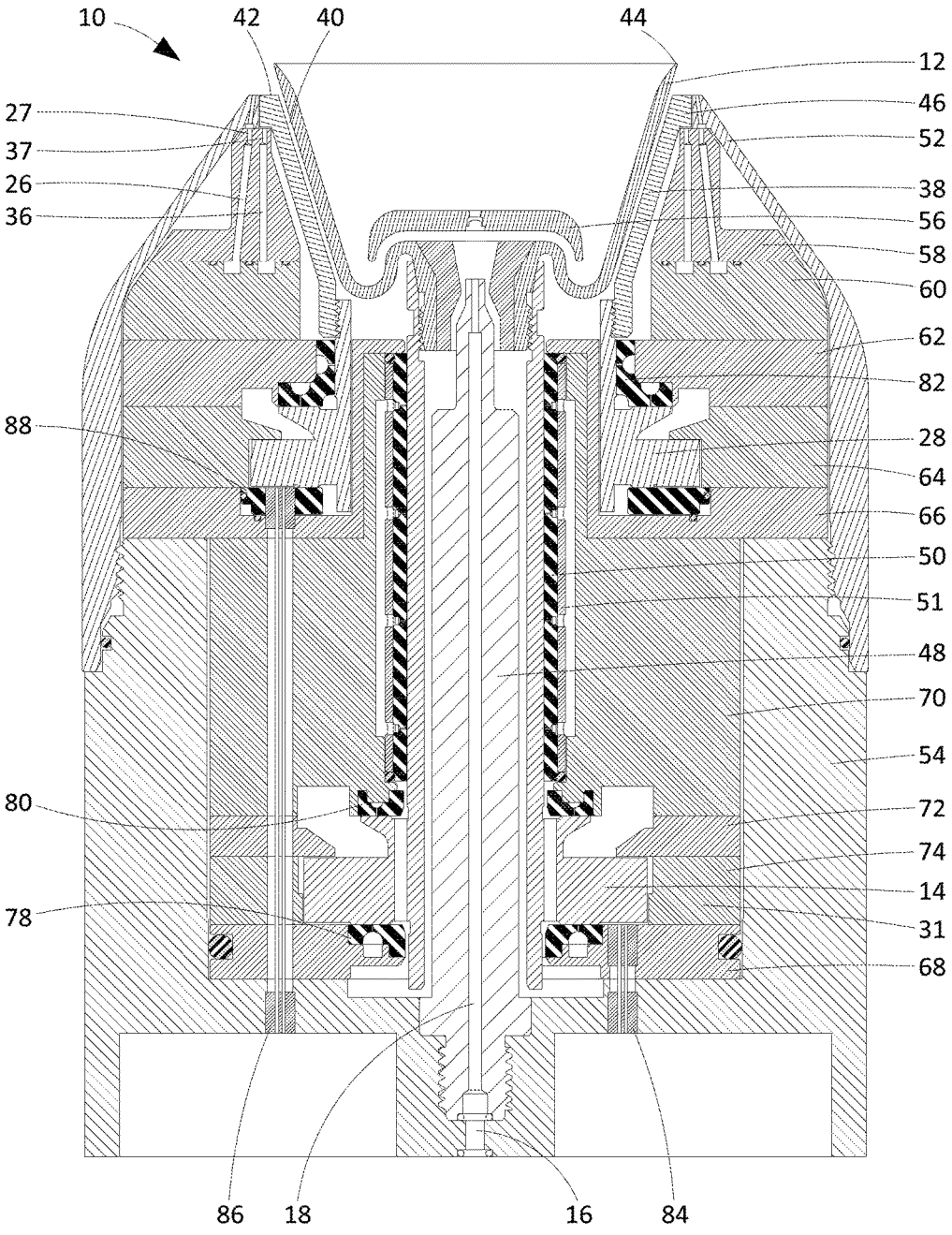
FIG. 2 is a cross-sectional view of the embodiment depicted in FIG. 1 taken along a common plane through fiber optic cables which monitor the respective speeds of the main turbine and the auxiliary turbine/vortex generator.

FIG. 2 is a cross-sectional view of the rotary bell cup atomizer 10 of the invention identical to that of FIG. 1 except this view is taken along a plane through the atomizer offset from the plane of FIG. 1 to depict the fiberoptic main turbine speed monitor 84 and the second fiberoptic auxiliary turbine speed monitor 86. Otherwise, all components in FIGS. 1 and 2 having the same number designation are as described above in the descriptions of FIG. 1.

Figure 3:
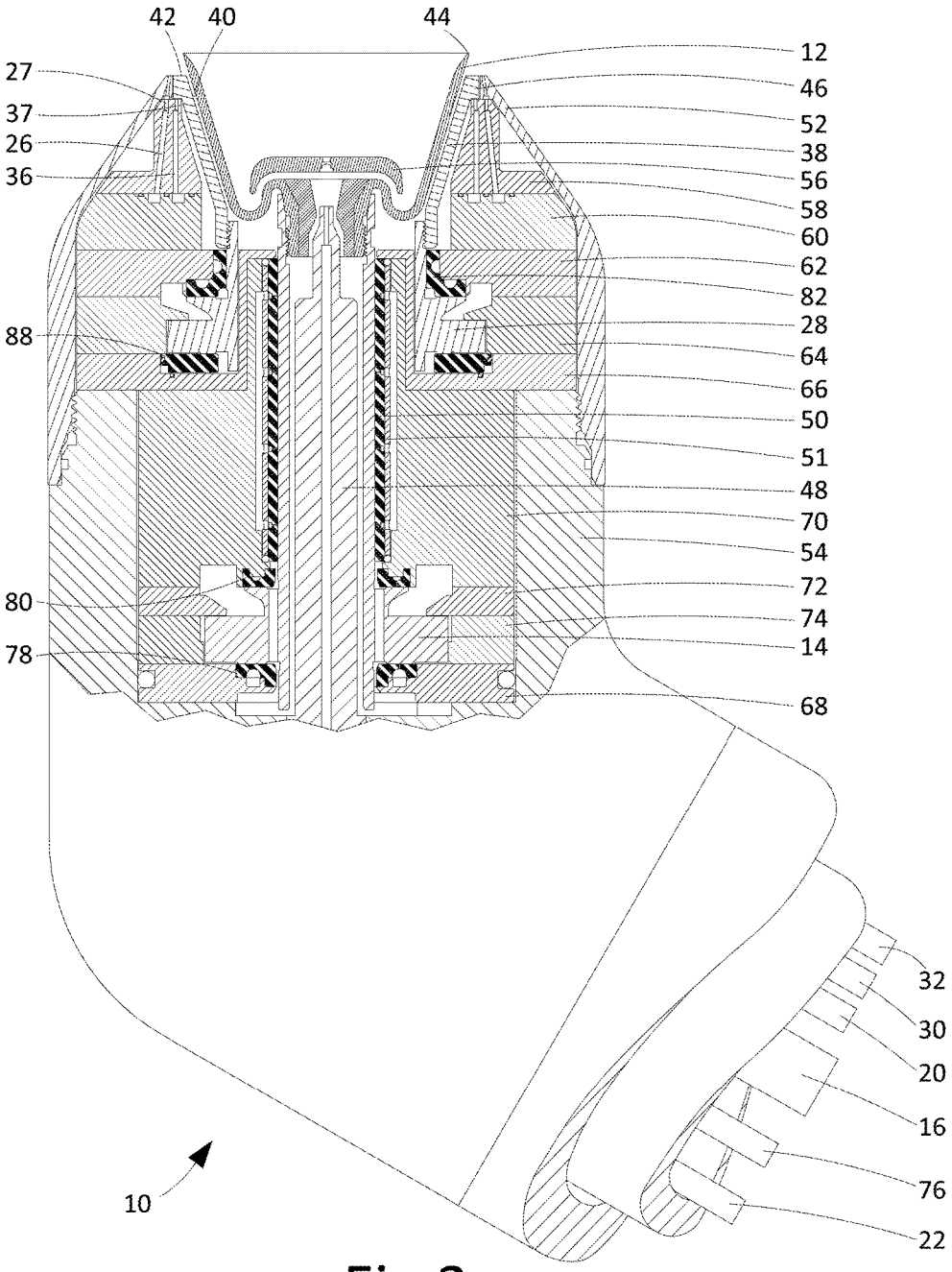
FIG. 3 is a perspective view, partially in cross-section, of the embodiment of FIG. 1.

FIG. 3 is a perspective view, partially broken away and partially in cross-section, of the coating apparatus 10 of the invention, schematically showing its attachment to a robotic arm through which the coatings and air supplies all pass. More specifically, coating material, e.g., paint, is supplied through inlet 16, air to drive the main turbine/drive shaft 14 is supplied through inlet 20, the first source of shaping air enters through inlet 22, air for driving the auxiliary turbine 28 is supplied through inlet 30, that air passing to the auxiliary turbine through channels 31, the second source of shaping air 32, air supplied through inlet 76 for channeling as shown to main bearing 50, proximal main thrust bearing 78 and distal main thrust bearing 80, and air supplied through inlet 76 and channeled to proximal auxiliary thrust bearing 88 and distal auxiliary thrust bearing 82, all as depicted in FIG. 3.

The cross-sectional portion of FIG. 3 is identical to FIG. 1, and all commonly numbered components are as described above with reference to FIG. 1.

Figure 4:
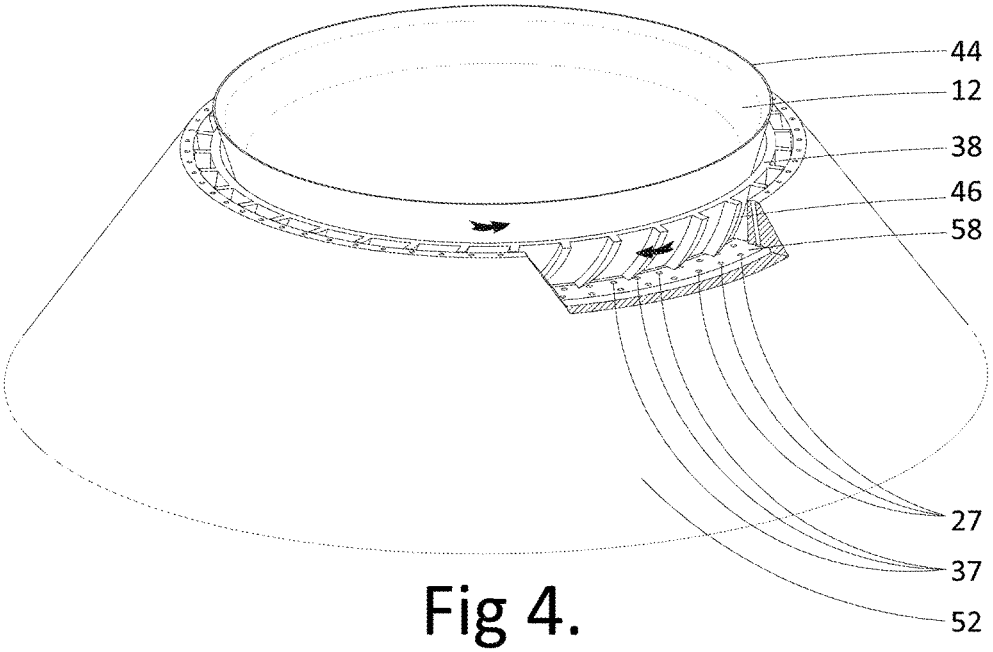
FIG. 4 is a perspective view, partially cut away and partially in cross-section, depicting the vortex generator of the invention and the bell cup to be rotating in opposite directions.

FIG. 4 is a perspective view, partly broken away, of the upper end of the bell cup atomizer, specifically, the distal edge 44 of the bell cup 12 from which the coating material exits onto the workpiece (not shown), the solid arrow on the cup indicating the direction of rotation of the cup 12. The vortex generator 38 is depicted as in clockwise rotation indicated by the solid arrow shown, the direction of rotation of the vortex generator 38 being the opposite of the counter clockwise direction of rotation of the bell cup 12. In the cutaway section of the figure, the vanes 46 of one embodiment of the vortex generator 38 are shown to be curvilinear and, as the generator 38 rotates, air exiting from the first and second plurality of shaping air nozzles, 27 and 37 respectively, passes between the rotating vanes 46 and mixes to form a combined curtain of air having a vortex pattern which is cast in an enveloping sheath about the sprayed coating being applied and which controls the coating's shape. In the figure, the air curtain and coating are not shown in order to focus on the specific operative components of the atomizer. Shroud 52 is included for completeness.

Figure 4A:
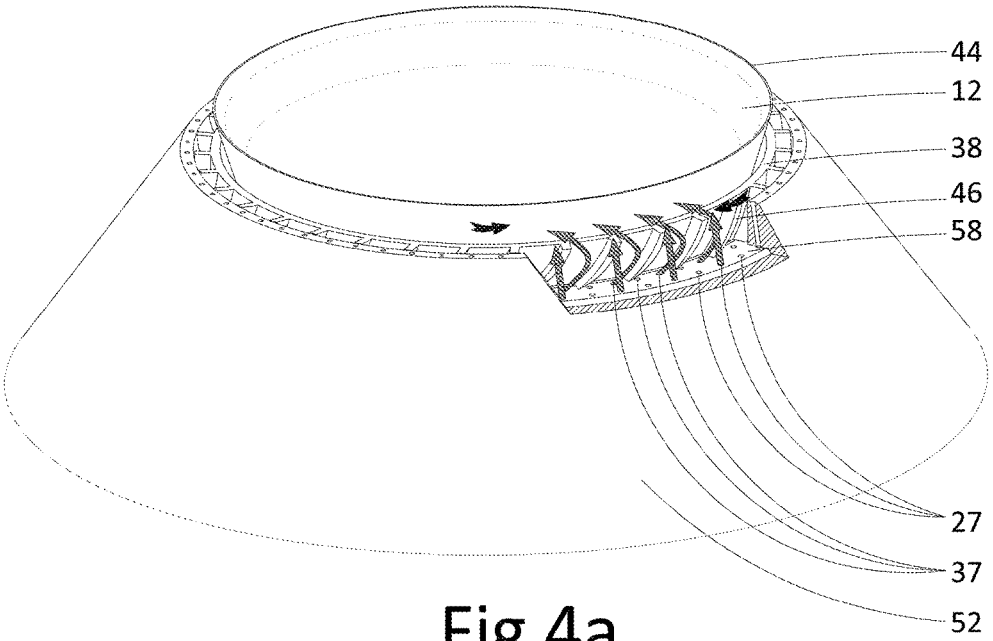
FIG. 4*a* is a duplicate of FIG. 4 showing the expected path of emitted shaping air about the periphery of the bell cup, indicated by the shaded curved arrows.

FIG. 4*a* is identical to FIG. 4, and common components have common designations. The shaded curved arrows directed outwardly from the nozzles 27 and 37 are a representation of predicted flow patterns exiting the nozzles and then mixing to form the final curtain of shaping air surrounding and controlling the pattern of the coating supplied to the workpiece (not shown).

Figure 5:
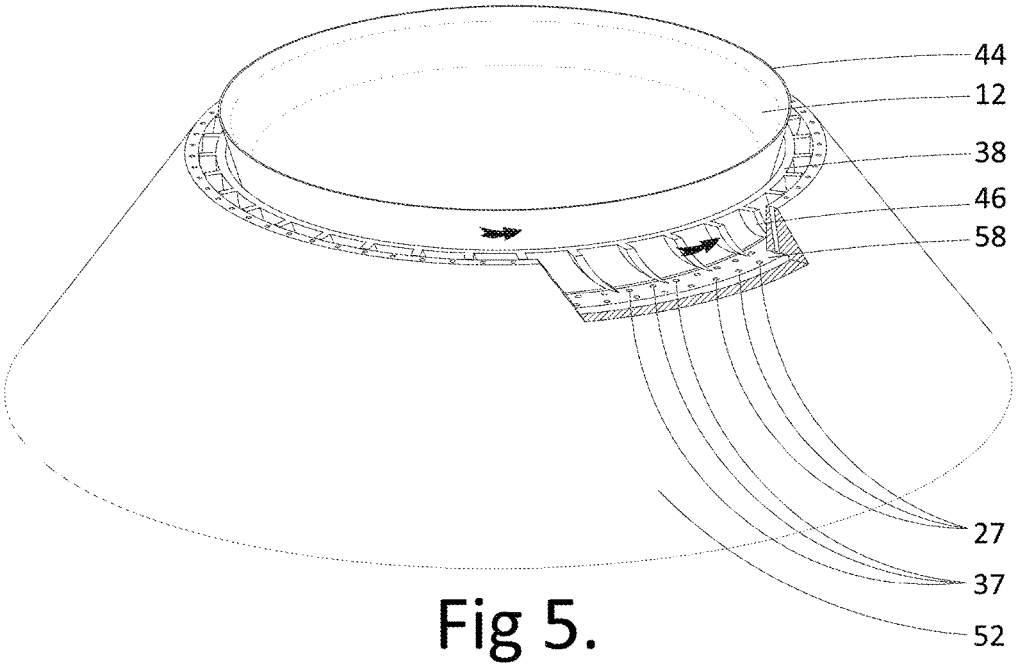
FIG. 5 is a perspective view, partially cut away and partially in cross-section, depicting the vortex generator of the invention and the bell cup to be rotating in the same direction.
Figure 5A:
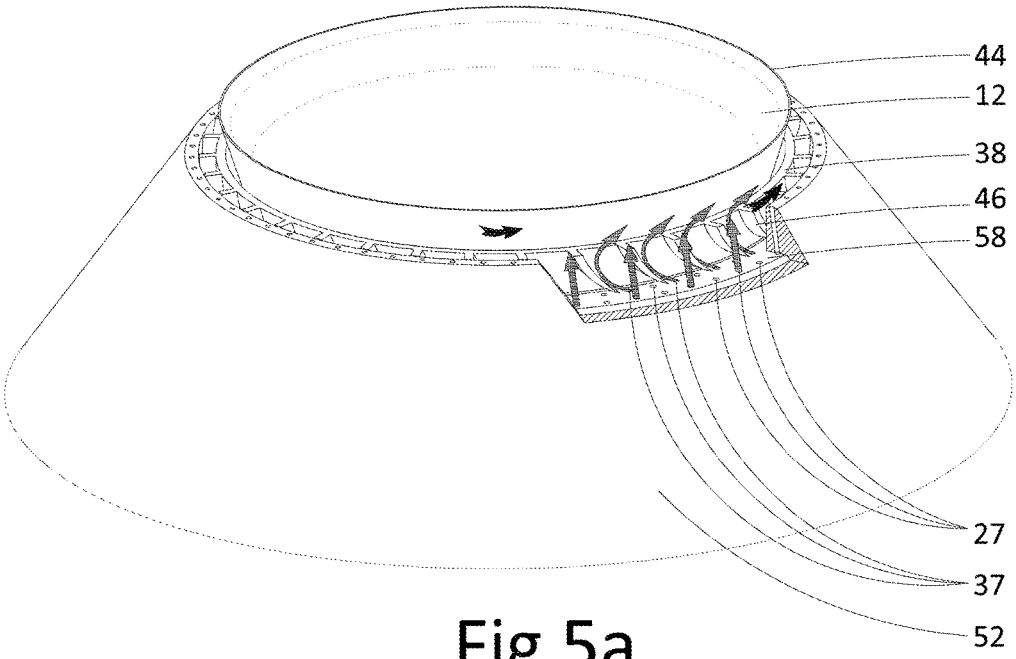
FIG. 5*a* is a duplicate of FIG. 5 showing the expected path of emitted shaping air about the periphery of the bell cup, indicated by the shaded curved arrows.

FIG. 5, in the perspective view, is identical to FIG. 4 except that both the vortex generator 38 and the bell cup 12 are rotating in the same counter clockwise direction. It should be readily apparent that both could also rotate clockwise without deviating from the scope of the invention. The speed and direction of rotation of both the bell cup and the vortex generator are independently controlled, and both can be rotated either clockwise or counterclockwise, in either the same direction or in opposite directions, as desired. The vortex generator rotational speed can conceivably vary over a wide range, from completely idle to 100,000 RPM. Also shown in FIG. 5*a*, represented by the shaded arrows, are expected patterns of shaping air exiting from the first and second plurality of shaping air nozzles, 27, and 37 respectively, enveloping and shaping the pattern of the applied coating (not shown).

In these figures, the vortex generator vanes 46 are all indicated to be curvilinear in shape. Other shapes, such as straight vanes extending perpendicularly from the vortex generator 38 and oriented parallel to or angled with respect to the centerline of the apparatus are optional and within the scope of the invention and will be apparent to one skilled in the art.

Figure 6:
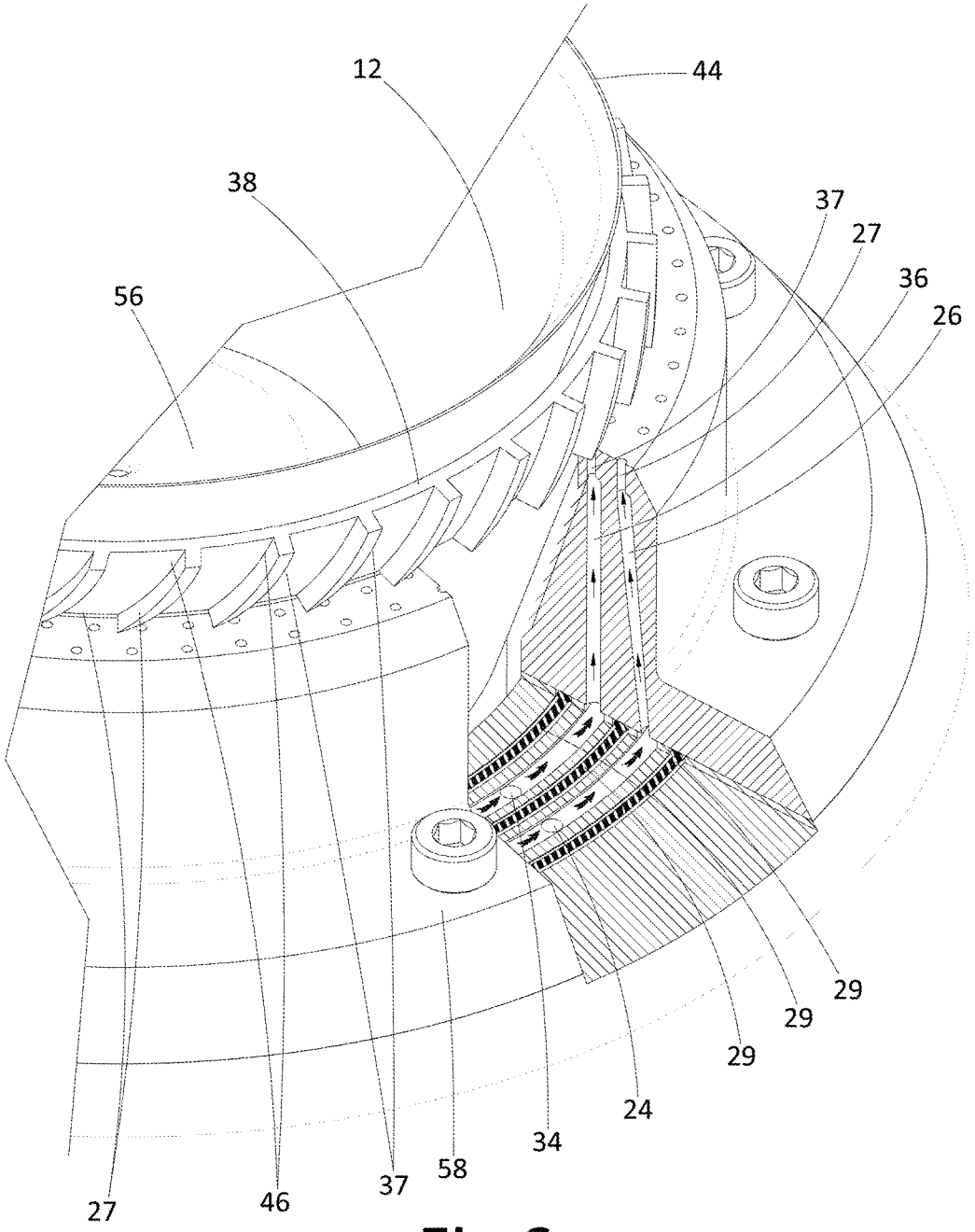
FIG. 6 is a sectional view, partially cut away and partially in cross-section, of the vortex generator, showing in detail the paths of shaping air through the air supply channels, the exit air conduits, and thence to, through and exiting from the first and second pluralities of shaping air nozzles into the spaces between rotating vanes of the vortex generator according to the invention.

FIG. 6 is an additional perspective view of the distal end of the atomizer apparatus 10, partially broken away and partially in cross-section, with the shroud 52 removed in order to illustrate schematically the operative components beneath the shroud. In the figure, the bell cup 12 having spray edge 44 and installed paint deflector 56, in operation, rotates about the central axis of the apparatus driven by the rotating main drive shaft 14 (not shown). The vortex generator 38 having vanes 46, mounted on the auxiliary drive shaft 28 (not shown), rotates concentrically with the bell cup 12 about the central axis, either in the same direction or in the opposite direction of rotation of the bell cup 12, rotating within the gap 40 described previously between the bell cup 12 and the shaping air ring 58. In the broken-away portion of FIG. 6, in cross-section, the shaping air channels 24 and 34, the exit air conduits 26 and 36, and the first and second plurality of shaping air nozzles 27 and 37, all described previously, are illustrated, wherein the directions of the shaping air in the several passageways are indicated by the smaller arrows depicted in each. Sealing "O"-rings 29 are included as shown, for completeness.

Figure 7:
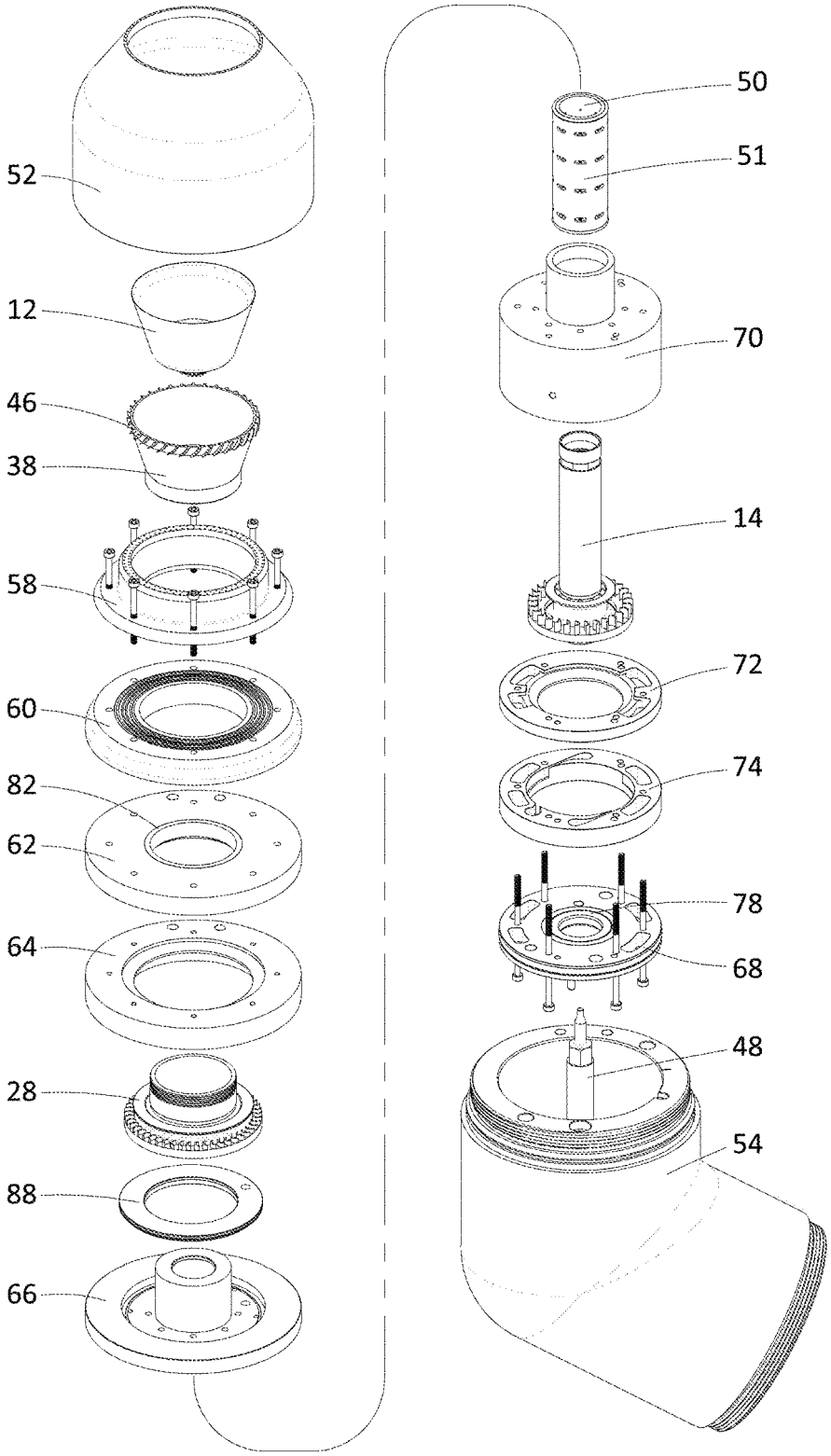
FIG. 7 is an exploded perspective view of the elements of the invention.

FIG. 7 depicts a schematic diagram of the components of the invention, specifically those through which the separate drive air and separate shaping air flows. In flow-direction sequence with reference to the figure, and with cross-reference to the more detailed FIGS. 1-6, the components include the manifold housing 54 in which is located the paint injector 48 (housed within the main drive shaft 14 on assembly), the lower base plate 68, the proximal thrust bearing 78, lower drive plate 74, lower spacer plate 72, main drive shaft 14 (illustrating the flywheel and turbine blades), top plate 70, main drive shaft main bearing sleeve 51, main drive shaft main bearing 50, upper base plate 66, proximal vortex generator shaft thrust bearing 88, annular vortex generator auxiliary drive shaft 28 (illustrating the auxiliary flywheel/turbine blades), upper drive plate 64, upper spacer plate 62, distal vortex generator shaft (28) thrust bearing 82, shaping air divider plate 60, shaping air ring 58, vortex generator 38, vanes 46 of the vortex generator, bell cup 12, and external upper shroud, all as described in detail above.

Materials of construction of the above components are generally known. See, e.g., the prior art cited above. Preferred materials herein include carbon for all bearing materials, both solid and porous and alternating porous/nonporous, and elastomeric "O"-rings are preferred, with fluoroelastomeric "O"-rings being most preferred.

While the invention has been disclosed herein in connection with certain embodiments and detailed descriptions, it will be clear to one skilled in the art that modifications or variations of such details can be made without deviating from the gist of this invention, and such modifications or variations are considered to be within the scope of the claims hereinbelow.

What is claimed is:

1. Apparatus for coating a substrate comprising:

a rotatable bell cup coating applicator affixed to the distal end of a rotatable main drive shaft driven by a main turbine, and including a source of supply of coating material, wherein said main drive shaft has an axial conduit therethrough for supplying coating material from said source to and through said main drive shaft and into said bell cup for spraying said coating material onto said substrate upon actuation of rotation of said main drive shaft, including multiple pressurized air sources and air passageways formed within and through said apparatus to convey air to and through said apparatus, including a first source of pressurized air for driving said main turbine, a second source of pressurized air for creating and directing a first curtain of shaping air circumferentially, axially and externally about said bell cup to envelop, control and shape the diameter and pattern of said coating material sprayed from said bell cup, this first curtain of shaping air being formed by air conveyed from said second source of pressurized air and channeled through passageways in said apparatus to and through a first plurality of axially oriented nozzles positioned circumferentially adjacent to and around the outer edge of said bell cup, to form said first curtain of shaping air, and also including a second, hollow, independently rotatable drive shaft mounted on, radially and externally of, and being concentric with, said main drive shaft, said second drive shaft being driven by a second, auxiliary turbine, and including a third source of pressurized air for driving said auxiliary turbine, said auxiliary turbine being driven and controlled independently and separately from said main turbine, and further including a fourth source of air for creating a second curtain of shaping air circumferentially, axially and externally about said bell cup to further control and shape the diameter and pattern of said coating material sprayed from said bell cup, this second curtain of shaping air being formed by said air conveyed from said fourth source of pressurized air and channeled through passageways in said apparatus to and through a second plurality of axially oriented nozzles positioned circumferentially adjacent to and around the outer edge of said bell cup and in immediate proximity to said first plurality of nozzles, thereby, in operation on actuation of said turbines, forming said second curtain of shaping air, the apparatus also including a vortex generator mounted on said second drive shaft proximate the distal end of said second drive shaft adjacent the outer surface of said bell cup, the vortex generator having an annular shape with an inner surface extending along and generally mirroring the outer surface of the adjacent bell cup, said vortex generator being rotatable within a gap provided between said bell cup and said vortex generator, said vortex generator having a distal edge extending to near proximity with the spray edge of said adjacent bell cup and having a plurality of shaped vanes affixed thereto and thereabout proximate said distal edge of said vortex generator and extending perpendicularly and outwardly therefrom, said vanes configured with respect to said second plurality of nozzles such that in operation, said second curtain of shaping air exiting from said second plurality of nozzles is directed to, impacts and passes between said vanes, is deflected by said vanes, and is mixed with said first curtain of shaping air emerging from said adjacent first plurality of nozzles, the mixed first and second curtains of shaping air thereby producing a final, mixed applied curtain of shaping air for ultimately controlling the pattern of said coating sprayed onto said substrate.

2. The apparatus of claim 1 wherein said shaping air exiting from said second plurality of nozzles is deflected by said vanes in a swirl pattern.

3. The apparatus of claim 1 wherein said rotatable bell cup coating applicator and said rotatable vortex generator are rotatable in opposite directions.

4. The apparatus of claim 1 wherein said rotatable bell cup coating applicator and said rotatable vortex generator are rotatable in the same direction.

5. The apparatus of claim 1 wherein all nozzles within said first plurality of nozzles are directed in parallel with the axis of rotation of said rotatable bell cup.

6. The apparatus of claim 1 wherein all nozzles within said first plurality of nozzles are directed angularly with respect to the axis of rotation of said rotatable bell cup.

7. The apparatus of claim 1 wherein all nozzles within said second plurality of nozzles are directed in parallel to the axis of rotation of said rotatable bell cup.

8. The apparatus of claim 1 wherein all nozzles within said second plurality of nozzles are directed angularly with respect to the axis of rotation of said rotatable bell cup.

9. The apparatus of claim 1 wherein said plurality of shaped vanes extends linearly and proximally inwardly from said distal edge of said vortex generator.

10. The apparatus of claim 1 wherein said plurality of shaped vanes extends in a curvilinear fashion inwardly and proximally from said distal edge of said vortex generator.

11. The apparatus of claim 1 wherein said coating material is paint.

12. The apparatus of claim 1 wherein said coating material is a powder.

13. The apparatus of claim 1 wherein said first plurality of axially oriented nozzles includes 10 to 120 nozzles.

14. The apparatus of claim 1 wherein said second plurality of axially oriented nozzles includes 10 to 120 nozzles.

15. The apparatus of claim 1 wherein said rotatable bell cup coating applicator and said rotatable vortex generator are rotatable in opposite directions, all nozzles within said first plurality of nozzles are directed in parallel with the axis of rotation of said rotatable bell cup, all nozzles within said second plurality of nozzles are directed angularly with respect to the axis of rotation of said rotatable bell cup, said plurality of shaped vanes extends in a curvilinear fashion inwardly and proximally from said distal edge of said vortex generator, and wherein said coating material is paint.

* * * * *